United States Patent [19]

Chacin U.

[11] Patent Number: 4,974,673

[45] Date of Patent: Dec. 4, 1990

[54] SYSTEM FOR THE PRODUCTION OF CRUDE OIL BY THE INJECTION OF TREATMENT FLUIDS

[75] Inventor: Jesus E. Chacin U., Tulsa, Okla.

[73] Assignee: Intevep, S.A., Caracas, Venezuela

[21] Appl. No.: 486,296

[22] Filed: Feb. 28, 1990

[51] Int. Cl.[5] ..... E21B 43/12

[52] U.S. Cl. ..... 166/68; 166/106; 166/902

[58] Field of Search ..... 166/105, 369, 372, 310, 166/110, 68, 902, 105.2, 105.4, 106; 417/313

[56] References Cited

U.S. PATENT DOCUMENTS

| | | | |
|---|---|---|---|
| 3,802,802 | 4/1974 | Greer | 417/313 |
| 4,573,529 | 3/1986 | Reinhardt | 166/68 |
| 4,759,407 | 7/1988 | Ripley | 166/369 |
| 4,791,985 | 12/1988 | Flores Bermudez | 166/106 |

*Primary Examiner*—Bruce M. Kisliuk
*Assistant Examiner*—Terry Lee Melius
*Attorney, Agent, or Firm*—Bachman & LaPointe

[57] ABSTRACT

The present invention relates to a system for improving the production of crude oil for underground reservoirs by the injection of treatment fluids. The system includes a subsurface oil pump for pumping oil from the reservoir to the surface and includes a metering mechanism for selectively introducing treatment fluids into the pumping chamber during oil recovery. A specific feature of the present invention is the provision of a seating nipple for sealingly receiving the pump within the production tube of the well. In accordance with a particular feature of the present invention, a metering value is incorporated within the pump barrel thereby allowing the pump barrel and metering valve to be removed from the production tube as a unit for easy replacement and repair thereof. Furthermore, by selecting differently designed connecting adaptors, both insert type and tubing type subsurface pumps can be used with the metering valve assembly.

13 Claims, 6 Drawing Sheets

SYSTEM FOR THE PRODUCTION OF CRUDE OIL BY THE INJECTION OF TREATMENT FLUIDS

BACKGROUND OF THE INVENTION

The present invention is drawn to a system for improving the production of crude oil by the injection of treatment fluids into the pumping chamber of a subsurface oil pump and, more particularly, a system for securing the pump within the production tube of the well thereby allowing a pump barrel with the metering valve for introducing treatment fluids into the pump chamber to be removed from the production tube as a unit.

It is a further feature of the present invention to provide an inlet valve-metering valve assembly which is adapted to be used with various sized pump barrel-pump piston assemblies. There are various methods known in the prior art for injecting treatment fluids into a production well. The term treatment fluids embraces all types of fluids which might be employed including viscosity reducing fluids, maintenance fluids, corrosion inhibitor fluids and the like.

FIG. 1 depicts a typical production system known in the prior art for introducing treatment fluids into a well In accordance with the system illustrated in FIG. 1, an injection of the treatment fluid takes place in an annular space defined between the well casing and the production tube. Mixing of the crude oil in the treatment fluids occurs in an area below the intake valve of the subsurface oil pump. This procedure has been found to be unsatisfactory due to the fact that hydrostatic pressure is exerted by the column of treatment fluid injected into the well on the underground reservoir. This pressure exerted on the underground reservoir diminishes the rate at which crude oil from the underground formation enters the well thereby decreasing the efficiency of oil production.

A further system known in the prior art for injecting treatment fluids into an underground reservoir is illustrated in FIG. 2. In the particular arrangement shown in FIG. 2, the treatment fluid is injected down the production tube and the mixing of the treatment fluid and oil occurs within a perforated nipple located some distance above the subsurface oil pump. The treatment fluids-oil mixture flows to the surface of the well via perforations in the nipple wherein the mixture is transferred to the annular space defined by the well casing in the production tube. There are two major disadvantages associated with the foregoing arrangement. One disadvantage results from the fact that the treatment fluid does not pass through the production subsurface oil pump when injected in this manner. As a result, the high viscosity of the crude oil can cause deterioration of the pump components and ultimate failure of the pump. In addition, in the arrangement shown in FIG. 2, it is impossible to introduce anti-corrosive treatment fluids to protect the pump components. A further disadvantage results from the fact that it is extremely difficult to control with precision the amount of treatment fluid admixed with the oil.

A known method for the controlled introduction of treatment fluids into a well is disclosed in U.S. Pat. No. 4,791,985 and is schematically illustrated in FIG. 3. The system disclosed in the '985 patent overcomes many of the disadvantages noted above with regard to other known prior art systems. As can be seen in FIG. 3, the system includes a subsurface oil pump which communicates with the annular space defined between the production tube and the well casing for introducing treatment fluids into the pump chamber. A metering valve is provided for controlling the flow of treatment fluid into the pump chamber thereby allowing for the precise control of the quantity of treatment fluid being introduced. Thus, the prior art system shown in FIG. 3 overcomes the disadvantage of not being able to precisely control the introduction of treatment fluids. The system of FIG. 3, however, does suffer from one particular disadvantage in that the metering valve assembly is part of the production tube and, therefore, if the metering valve mechanism were needed to be removed in order to be repaired, it would be necessary to extract the whole production tube from the well. Such an operation would be extremely expensive in terms of both operating costs and production delays. A further disadvantage associated with the system shown in FIG. 3 and disclosed in the '985 patent is that the system can only be easily implemented in conjunction with tubing type subsurface pumps. An insert type pump cannot be effectively used due to the fact that it could not avoid the establishment of hydrostatic pressures against the oil reservoir which, as noted above with regard to FIG. 1, produces the negative effect of diminished efficiency of oil production. It is beneficial and advantageous to employ insert type pumps because they can readily be installed and removed from the well without having to extract the production tube from the well.

Accordingly, it is a principal object of the present invention to provide a system for improving the recovery of crude oil from a well which is capable of introducing precise quantities of treatment fluid to the pumping chamber of a subsurface oil pump.

It is a particular object of the present invention to provide a system as set forth above wherein a metering valve for controlling the introduction of treatment fluid into the pumping chamber is associated with the subsurface oil pump thereby allowing the pumping metering valve to be removed from the production tube as a unit.

It is still a further object of the present invention to provide a system as set forth above wherein the production tube is provided with a seating nipple for sealingly receiving a metering valve assembly which is adapted to receive subsurface oil pumps of both the barrel insert and barrel tubing type.

Further objects and advantages of the present invention will become more apparent from the following detailed description.

SUMMARY OF THE INVENTION

The system for the injection of treatment fluids into a well in accordance with the present invention overcomes all of the disadvantages noted above with regard to the prior art systems. Firstly, the system of the present invention allows for the precise introduction of treatment fluids into a well. Secondly, the introduction of treatment fluid can be accomplished without creating hydrostatic back pressure on the well formation. Thirdly, production oil cannot by-pass the subsurface pump. Finally, and most importantly, the system of the present invention allows for the utilization of different types of subsurface oil pumps which can be readily removed and replaced along with the metering valve for repair, if necessary, without the need of extracting the production tube from the well.

The oil recovery system in accordance with the present invention includes a production tube in a well casing wherein the production tube includes a seating nipple for receiving the subsurface oil pump. The subsurface oil pump is provided with a pump barrel which seats on the seating nipple for supporting the pump within the production tube. The pump barrel defines with the seating nipple an annular space. The pump includes a pumping chamber defined by the pump barrel including an inlet and outlet valve and a reciprocating piston for drawing oil from the reservoir into the pumping chamber through the inlet valve and expelling oil from the pumping chamber to the outlet valve to the surface of the well.

In accordance with the particular feature of the present invention, first and second seals are positioned within the annular space between the pump barrel and the seating nipple so as to prevent leakage of fluid around the pump barrel. The sealing means define with the pump barrel and the seating nipple a sealed annular compartment within the annular space between the barrel and the seating nipple.

In accordance with the specific features of the present invention, a first fluid passage is provided in the production tube for communicating treatment fluids from the annular space defined by the production tube and the well casing to the sealed annular compartment within the annular space defined by the pump barrel and the production tube. A second fluid passage is provided in the pump barrel for communicating the sealed annular compartment with the pumping chamber.

In accordance with a further specific feature of the present invention, a metering valve, which precisely controls the introduction of treatment fluid into the pump chamber, is provided with a second fluid passage in the pump barrel downstream of the annular compartment for selectively communicating treatment fluids with the pump chamber when oil is introduced into the pump chamber through the inlet valve. This particular arrangement, wherein the metering valve is incorporated within a barrel portion of a subsurface oil pump, allows for removal of the pump barrel and metering valve as a unit from the production tube so as to allow for repair and the like.

In addition, the system of the present invention is adaptable so as to allow for employment of different types of subsurface oil pumps within the production tube. To accomplish the foregoing, the pump barrel comprises a first portion which includes the metering valve and is seated in the seating nipple. A connecting adaptor connects the first portion of the pump barrel to a second portion of the barrel having the reciprocal piston. By selecting differently designed connecting adaptors, various types of pump bodies can be used with the metering valve assembly.

In operation, the column of treatment fluid is injected into the annular space defined by the well casing and the production tube. During a first phase when the piston is raised, the inlet valve to the pump chamber opens and crude oil flows into the pumping chamber. During the upward stroke of the piston, the metering valve opens and fluid in a pre-determined amount enters the pump chamber from the annular compartment between the pump barrel and the production tube wherein the oil and treatment fluid are thoroughly mixed within the pumping chamber. As the piston begins its descent, the inlet valve and the metering valve close and the compression phase within the pumping chamber begins. As the piston descends, the pressure created on the oil-treatment fluid mixture increases to a point greater than the pressure above the piston at which point the oulet valve from the pumping chamber opens and the oil-treatment fluid mixture flows out of the pumping chamber. The process is thereafter continually repeated which allows the oil-treatment fluid mixture to be drawn to the surface of the well.

As noted above, the system of the present invention may be used to introduce diluting treatment fluids to the pump to reduce the viscosity of the oil being extracted. It may also be used to introduce anti-corrosion fluids, maintenance fluids and any other fluid which is desirable.

DETAILED DESCRIPTION

As noted above, the present invention relates to an improved method for recovering crude oil from a well. The invention also contemplates a system for introducing in a controlled manner treating fluids into a well. The system of the present invention is capable of employing various types of subsurface oil pumps and readily allows for easy removal of the pump from the production tube of the well.

Figure 1:
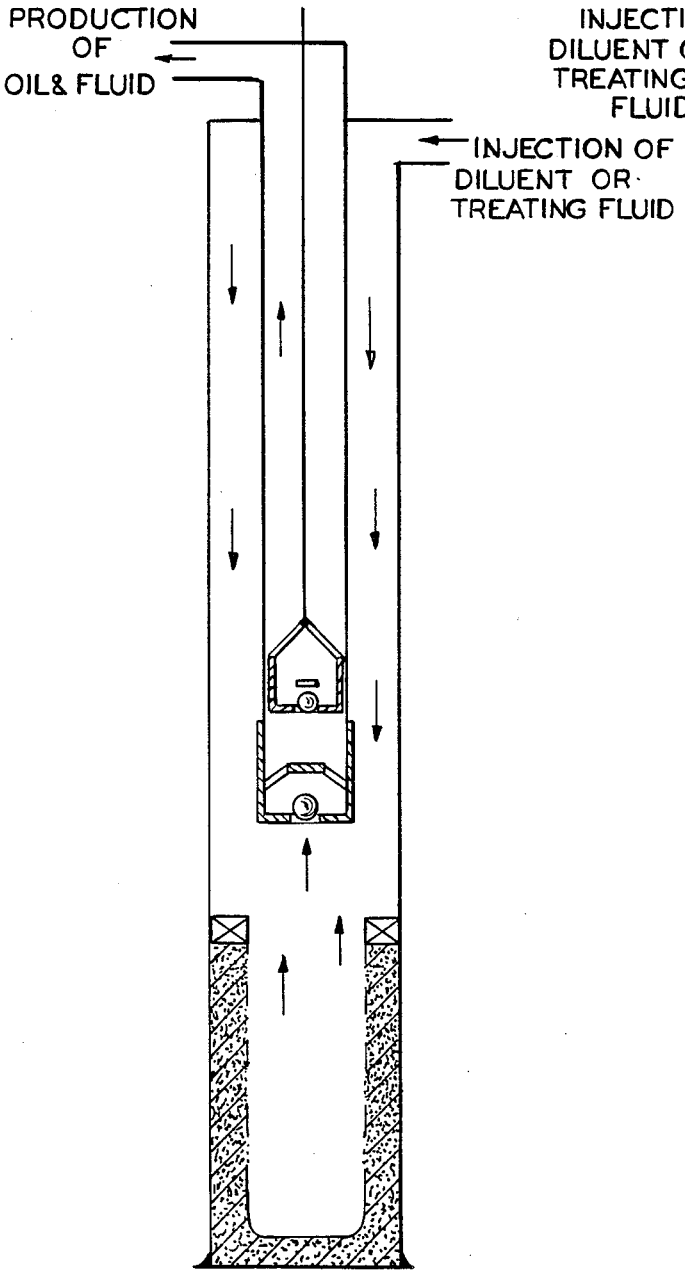
PRIOR ART FIG-1
FIG. 1 is a prior art system for introducing treatment fluids to a deep well.
Figure 2:
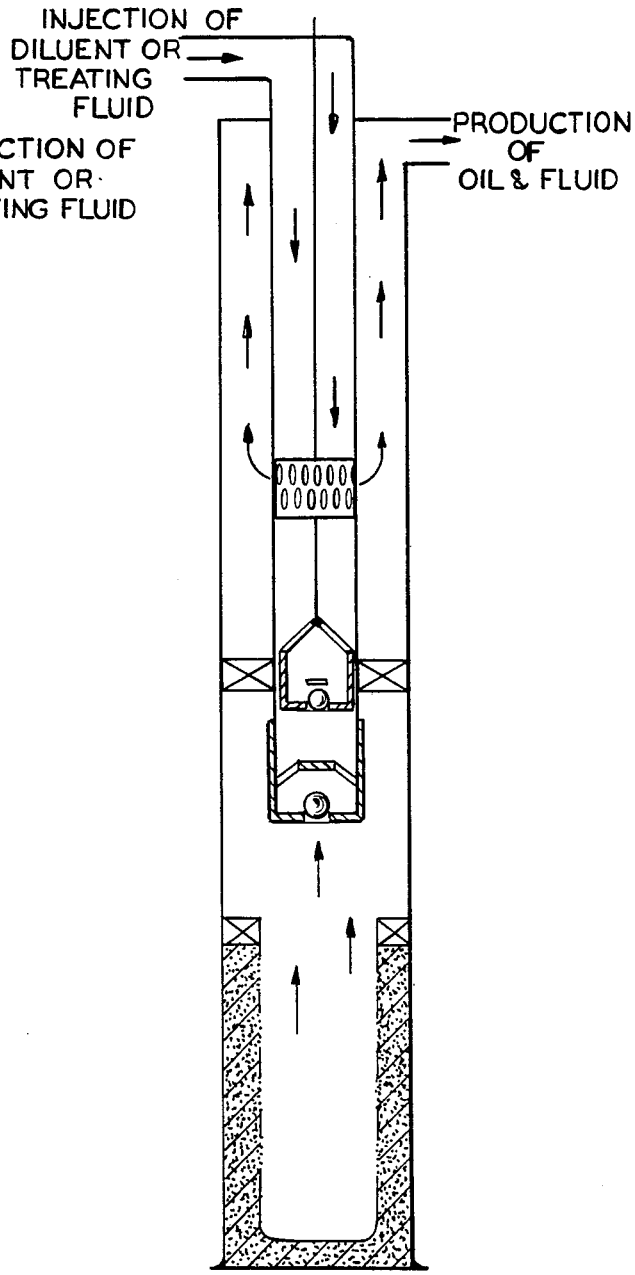
PRIOR ART FIG-2
FIG. 2 is a further prior art system for introducing treatment fluids to a deep well.
Figure 3:
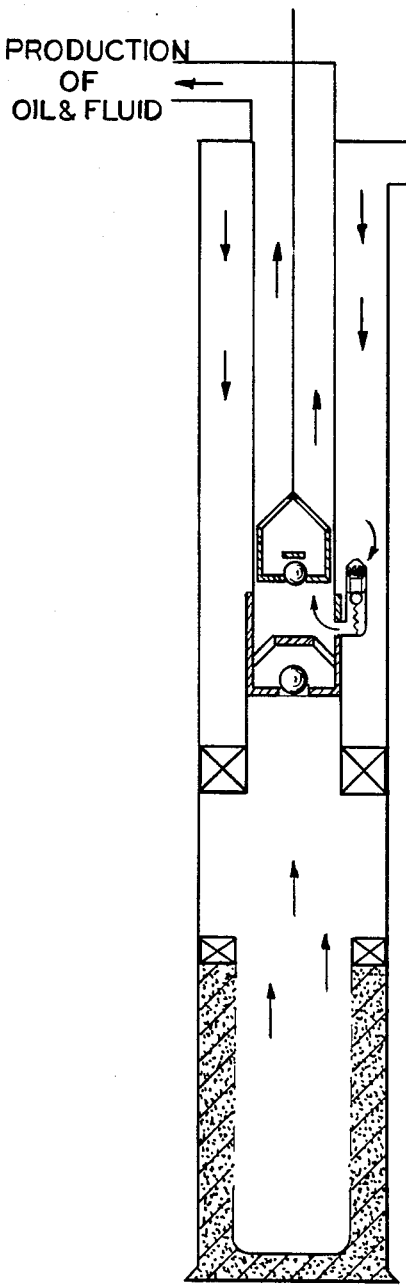
PRIOR ART FIG-3
FIG. 3 is a still further prior art system for introducing treatment fluids to a deep well.
Figure 4:
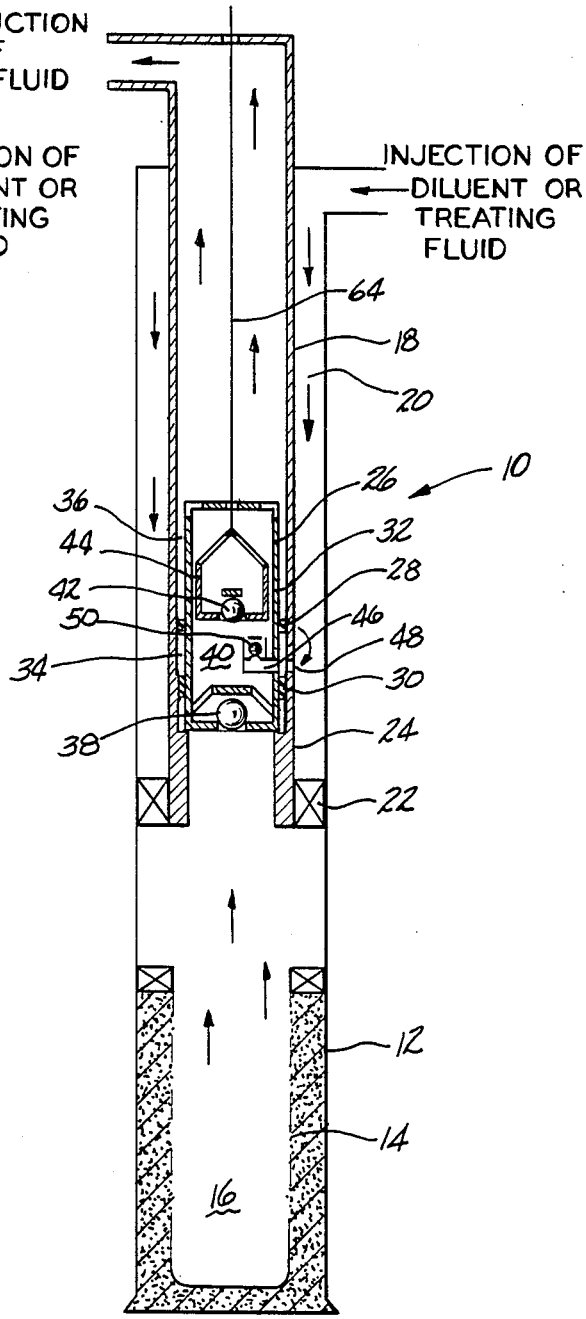
FIG. 4 is a schematic illustration of the oil recovery system in accordance with the present invention.

FIG. 4 is a schematic illustration of the system of the present invention for the production of crude oil from an underground reservoir by the injection of treatment fluids. The well includes a well casing 12 provided with a plurality of perforations 14 which permit fluids from the reservoir to enter the bore hole of the well. A production tube 18 is located within the well casing 12 and defines therewith an annular space 20 which is sealed from the well reservoir by means of suitable packing 22. The production tube 18 includes a seating nipple 24 which may be formed integrally with the production tube 18 or separately therefrom. If the seating nipple 24 is a separate item, it may be secured to the production tubing by a threaded attachment, press fit or other known manner.

Sealingly received within the seating nipple 24 is a subsurface pump 26. Anchoring sealing elements 28 and 30 are provided within the annular space 36 defined by the pump barrel 32 and the production tube 18 for sealing the pump 26 within the production tube 18. The anchoring seals 28 and 30 define with the pump barrel 32 and the production tube 18 a sealed compartment 34.

The annular seals 28 and 30 prohibit leakage of fluid around the pump 26 between the pump barrel 32 and the seating nipple portion 24 of the production tube 18. The subsurface pump 26 is provided with an inlet valve 38 for introducing oil into the pump chamber 40 of the subsurface pump 26. The inlet valve 38 may be in the form of a single retention-type ball check valve or any other suitable type of valve known in the art. An outlet valve 42 is carried in the pump piston 44 for delivering fluid from the pumping chamber 40 and up to the surface of the well via the production tube 18. Again, the outlet valve 42 may be of any suitable type known in the art.

In accordance with a particular feature of the present invention, the pump barrel 32 is provided with a passage 46 which communicates the pumping chamber 40 of the subsurface pump 26 with the sealed annular compartment 34 in the annular space 36 defined by the pump barrel 32 and production tube 18. A metering valve or valves 50 is (are) associated with the passage 46 in the pump barrel 32 for selectively introducing treatment fluids in precise amounts into the pumping chamber 40. The treatment fluids to be introduced in the pumping chamber 40 via the metering valve 50 are injected in the annular space 20 between the production tube 18 and the well casing 12 and communicate with the annular compartment 34 via passage means 48 provided in the production tube 18. The passage 48 may comprise a plurality of perforations provided in the seating nipple portion 24 of the production tube 18 to allow for easy communication of the treatment fluids with the annular compartment 34.

Figure 9:
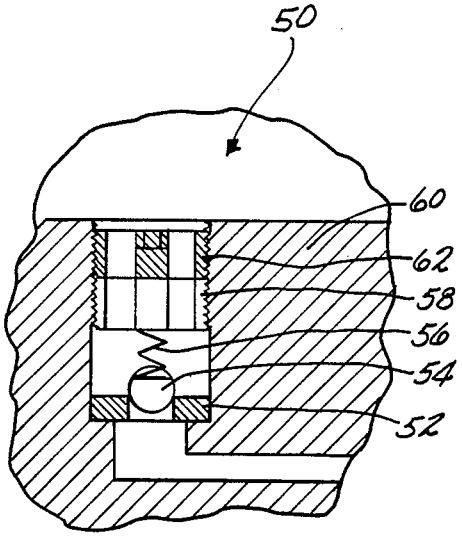
FIG. 9 is a partial cross sectional view of a preferred embodiment of a metering valve in accordance with the present invention.

FIG. 9 illustrates the preferred embodiment of the metering valve 50 employed in the system of the present invention. The metering valve 50 comprises a ball check valve having a seat 52 and a valve ball 54 which is biased to its closed position on the seat 52 by a spring 56. The tension of the spring 56 on the ball 54 is adjustable by means of a plug 58 which is threadably received in the valve housing 60. A blind plug 62 is threaded on top of adjusting plug 58 in order to insure that the adjusting plug 58 maintains its pre-set position. While the valve 50 is illustrated in its vertical position, it should be appreciated that the orientation of the valve and the passage from the annular chamber to the pumping chamber may be at any desired orientation. In addition, the check valves can be designed, as is well known in the art, to exhibit specific flow versus pressure drop characteristics as required. These particular features are well known in the valve art.

The operation of the system will now be described with reference to FIG. 4. Sucker rod string 64 is reciprocated via a suitable surface unit such as a reciprocating beam. The pump piston 44 is secured to the sucker rod string 64 and is reciprocated thereby in upward strokes and downward strokes. During the upstroke of the piston 44, a low pressure is created within the pumping chamber 40 which causes inlet valve 38 and metering valve 50 to open thereby allowing oil from the reservoir formation 16 and the treatment fluid to enter the pump chamber 40. The treatment fluid enters the pump chamber 40 from annular space 20 through holes 48 in the seating nipple portion 24 of production tube 18 into annular compartment 34 formed in the annular space 36 between the pump barrel 32 and the production tube 18. On the upward stroke of the piston 44, the fluid from the annular compartment 34 is drawn into the pumping chamber 40 via the metering valve 50. During the upward stroke, the outlet valve 42 remains closed due to the high pressure exerted by the column of fluid above the piston 44. During the downward stroke of the piston 44, fluid within the pumping chamber 40 is compressed which increases the pressure within the pumping chamber which in turn causes inlet valve 38 and metering valve 50 to close and outlet valve 42 to open thus forcing the fluid in the pumping chamber 40 upward through the outlet valve 42 and into the production tube 18 above the piston 44. The cycling of the upstrokes and downstrokes feeds the fluid via the production tube to the surface of the well.

As noted above, one of the specific features of the present invention is to provide a system wherein different size subsurface pumps may be employed in the same production system, for example, heavy barrel insert pumps, thin barrel insert pumps and heavy barrel tubing pumps. This specific feature will be described below with reference to FIGS. 5 through 8.

Figure 5A:
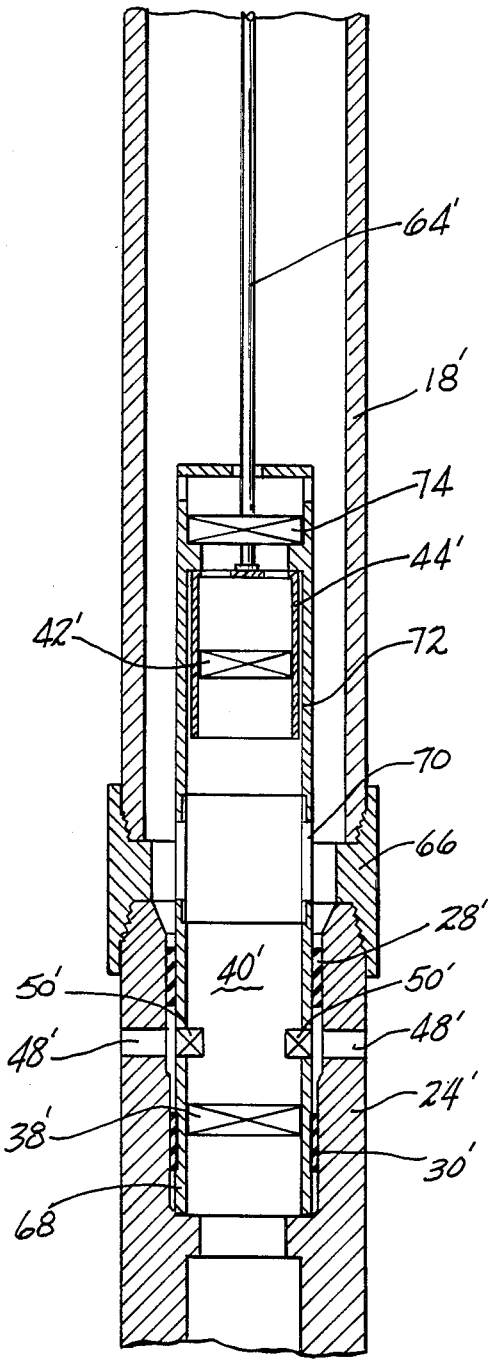
FIGS. 5A and 5B illustrate the employment of a heavy well barrel insert pump with the metering valve assembly in the system of the present invention.
Figure 5B:
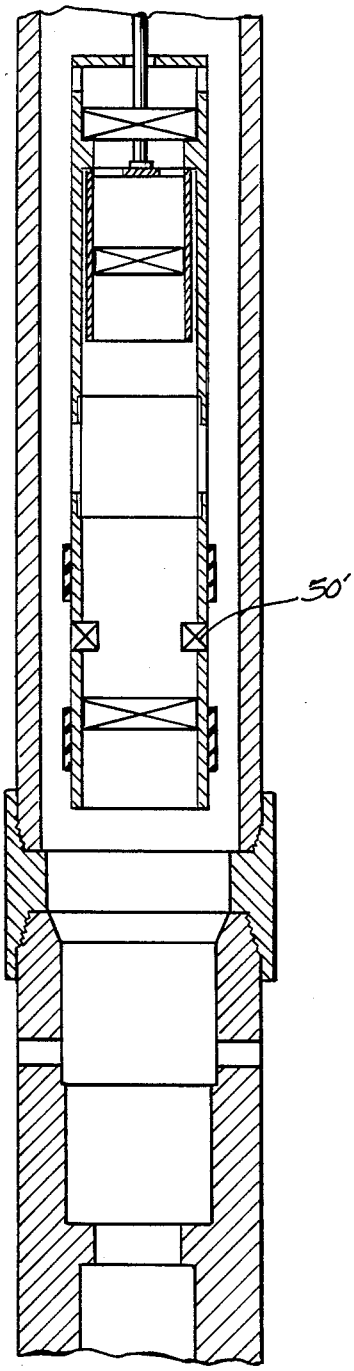

With reference to FIGS. 5*a* and 5*b*, there is schematically illustrated the system of the present invention employing a heavy barrel insert pump. The production tube 18' comprises the tube having the seating nipple 24' as a separate portion. The seating nipple is connected to the production tube 18' by means of a threaded coupling 66. The seating nipple arrangement is identical to that described above with reference to FIG. 4. The well casing has not been illustrated for the sake of simplicity. In order to accommodate different size pumps, the pump barrel comprises a separate portion 68 which is sealingly received in seating nipple 24' by anchor seals 28' and 30'. Pump barrel portion 68 carries inlet valve 38' for delivering oil from the reservoir to pumping chamber 40' and metering valve(s) 50' for introducing treatment fluids to pumping chamber 40'. Generally, two metering valves 50' are employed; however, any number of valves could be used as deemed necessary. A connecting portion 70 connects pump barrel portion 68 to the pump barrel portion of, in this case, a heavy barrel insert pump 72. The connecting portion 70 may be a threaded portion which mates with threads on barrel portions 68 and 72 or these portions can be press fitted together or held by any suitable coupling means known in the art. The pump may include an additional valve 74 downstream of outlet valve 42' for minimizing the effect of free gas on pumping efficiency. FIG. 5*b* illustrates how the complete pump with the metering valve 50' can be removed from the production tube 18' by pulling the sucker rod string 64'. Thus, the pump and metering valve can be removed from the well without the need of extracting the production tube as is required in the prior art.

Figure 6A:
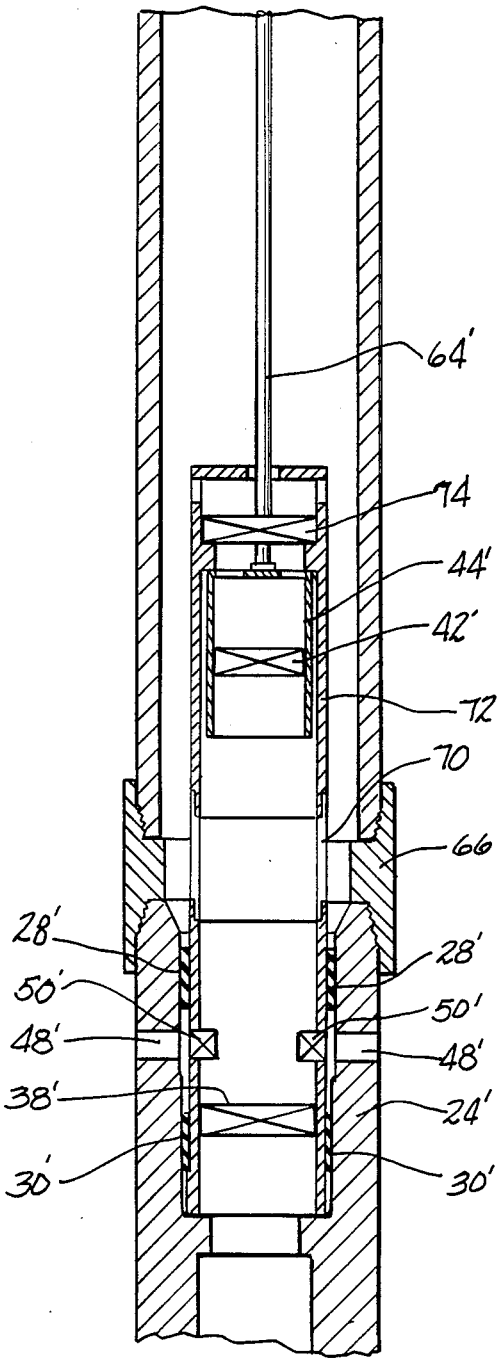
FIGS. 6A and 6B illustrate the employment of a thin well barrel insert pump with the metering valve assembly in the system of the present invention.
Figure 6B:
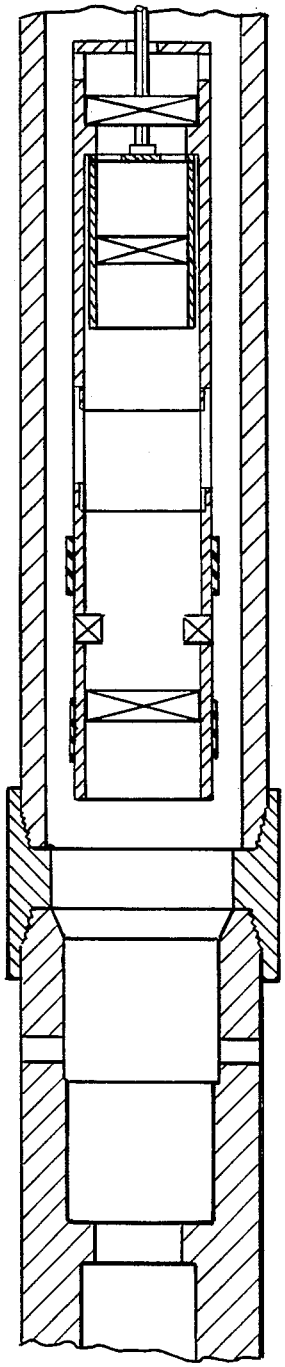

FIGS. 6*a* and 6*b* illustrate a similar arrangement to that of FIGS. 5*a* and 5*b* wherein a thin barrel insert pump is employed.

Figure 7A:
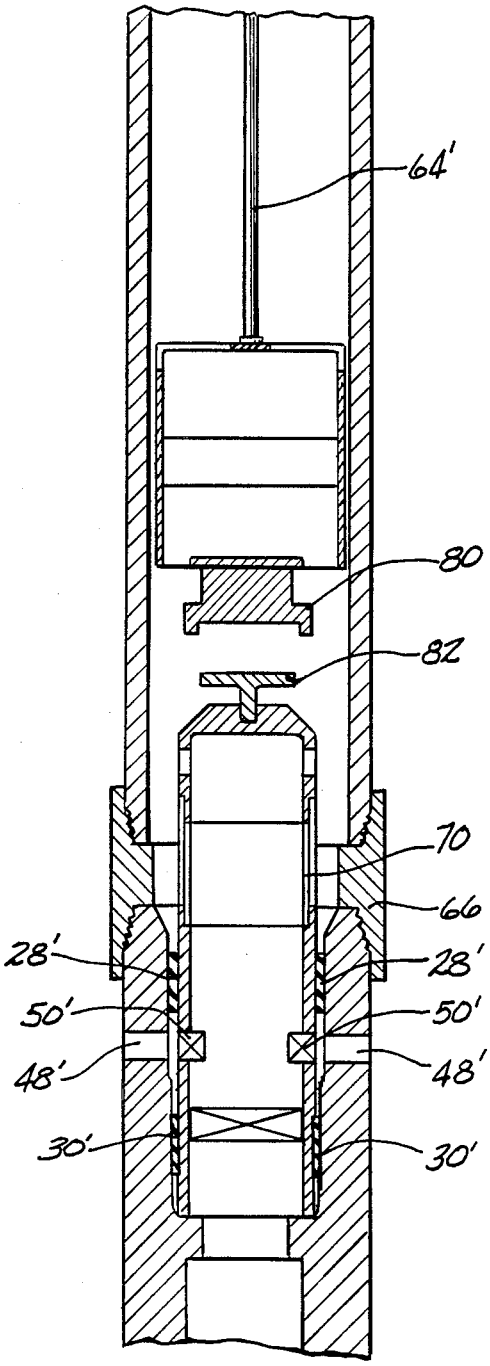
FIGS. 7A and 7B illustrate the employment of a heavy barrel tubing pump with the metering valve assembly in the system of the present invention.
Figure 7B:
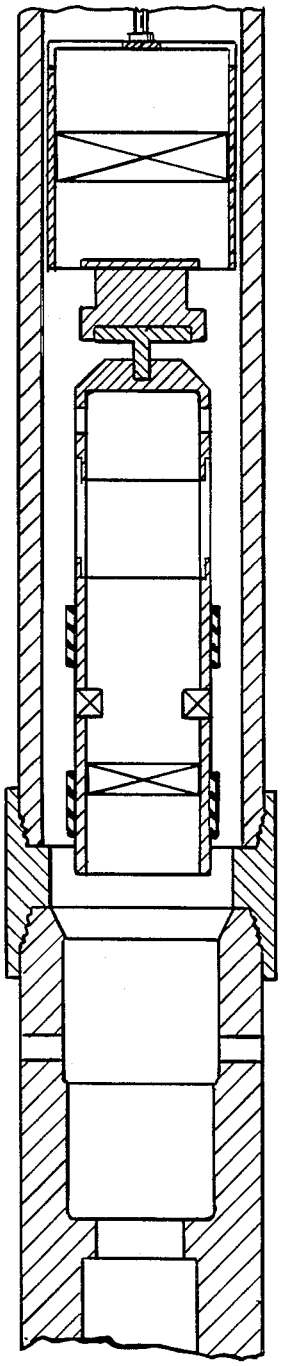

FIGS. 7*a* and 7*b* illustrate a similar arrangement to that of FIGS. 5 and 6 wherein a heavy barrel tubing pump is employed. By lowering the sucker rod string 64' from the surface, a plunger fishing connection 80 latches onto the fishing neck 82 of the heavy barrel tubing pump. By subsequent pulling up on the sucker rod string 64' the complete pump with the metering valve(s) 50' can be removed from the well in the same manner as discussed above with regard to FIGS. 5*a* and 5*b*.

Figure 8:
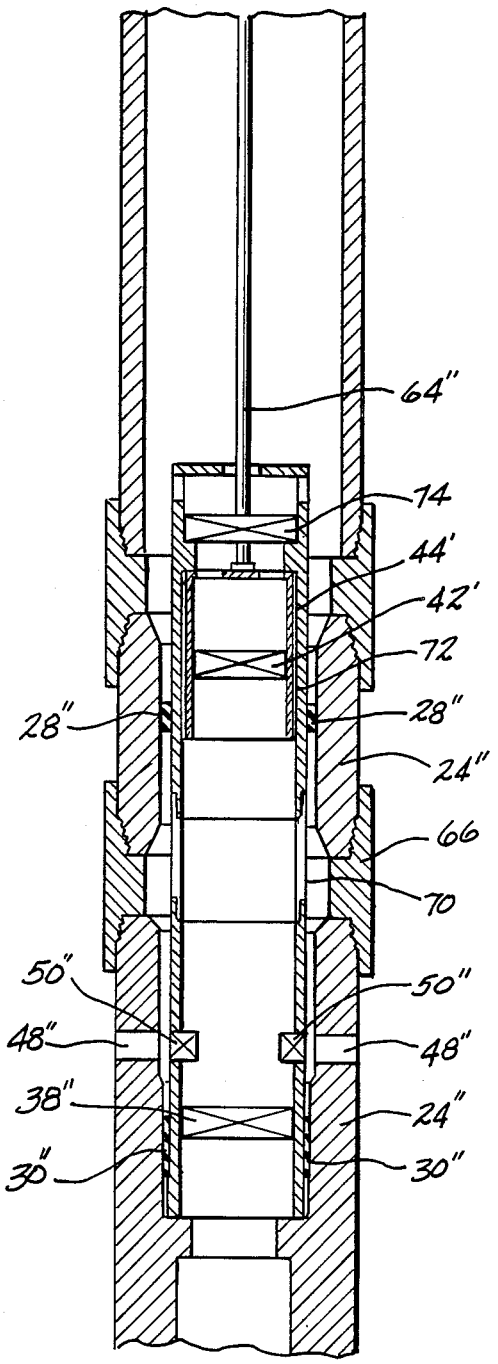
FIG. 8 is a second embodiment of the present invention employing two seating nipples.

An alternate embodiment of the present invention is illustrated in FIG. 8. In this embodiment, which can only be used with insert type pumps, both a top and a bottom seating nipple 24'' are employed with anchoring seals 28'' and 30''. The passage 48'' is illustrated in FIG. 8 as being in the bottom seating nipple 24''. However, the passage may be provided in any suitable location between the top and bottom seating nipples 24''. The operation and remaining parts of this arrangement are identical to that discussed above with regard to FIGS. 4–7.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A system for improving the production of crude oil from an underground reservoir by the injection of treatment fluids comprising:

a well casing;

a production tube including seating nipple means located within the well casing and defining therewith a first annular space for receiving treatment fluids;

packing means located within said first annular space between said seating nipple means and an oil reservoir for isolating said first annular space from said reservoir;

pump means having a pump barrel located within said seating nipple means and seated thereon for supporting said pump means within the production tube wherein said pump barrel defines with said seating nipple means a second annular space, said pump means including a pumping chamber defined by said pump barrel and having an inlet valve and an outlet valve and a piston reciprocally mounted for movement in a first direction wherein oil enters said pumping chamber through said inlet valve and in a second direction wherein said oil exits said pumping chamber through said outlet valve;

first and second sealing means positioned within said second annular space for sealing said pump barrel within said seating nipple means so as to prevent leakage of fluid between said pump barrel and said seating nipple means wherein said first and second sealing means, said pump barrel and said seating nipple means define with each other a sealed annular compartment within said second annular space;

first fluid passage means located in said production tube for communicating treatment fluids from said first annular space to said sealed annular compartment;

second fluid passage means located in said pump barrel for communicating treatment fluids from said sealed annular compartment to said pumping chamber between said inlet and said outlet; and metering valve means associated with said second fluid passage downstream of said annular compartment for selectively communicating treatment fluids with said pumping chamber when oil is introduced into said pumping chamber through said inlet valve thereby allowing said pump barrel and metering valve means to be removed from said production tube as a unit.

2. A system according to claim 1 wherein said seating nipple means is formed in one piece with said production tube.

3. A system according to claim 1 wherein said seating nipple means is separable from said production tube.

4. A system according to claim 3 wherein said seating nipple means is threaded on said production tube.

5. A system according to claim 1 wherein said metering valve means includes biasing means for biasing said valve to its closed position for prohibiting communication between said pumping chamber and said annular compartment when oil exits said pumping chamber through said outlet valve.

6. A system according to claim 5 wherein said biasing means is adjustable.

7. A system according to claim 5 wherein said metering valve means includes filtering means.

8. A system according to claim 1 wherein said pump includes valve means downstream of said outlet valve for minimizing the effect of free gas on pumping efficiency.

9. A system according to claim 1 wherein the pump barrel comprises a first portion including said inlet valve and said metering valve means, a second portion in which said piston reciprocates and a third portion for connecting said first and second portions.

10. A system according to claim 1 wherein said first portion is sealingly seated on said seating nipple.

11. A system according to claim 9 wherein said pump is a heavy barrel insert pump.

12. A system according to claim 9 wherein said pump is a light barrel insert pump.

13. A system according to claim 9 wherein said pump is a barrel tubing pump.

* * * * *